United States Patent [19]

Manley

[11] Patent Number: 5,076,587

[45] Date of Patent: Dec. 31, 1991

[54] GOLF CLUB SWING TRAINING BRACE

[76] Inventor: James J. Manley, 17671 Barry, Mt. Clemens, Mich. 48044

[21] Appl. No.: 693,334

[22] Filed: Apr. 29, 1991

[51] Int. Cl.[5] ..... A63B 69/36

[52] U.S. Cl. ..... 273/183 B; 273/189 A

[58] Field of Search ..... 273/189 R, 189 A, 183 B, 273/54 B; 128/77

[56] References Cited

U.S. PATENT DOCUMENTS

| | | | |
|---|---|---|---|
| 1,226,160 | 5/1917 | Allis | 273/189 A |
| 1,457,710 | 6/1923 | MacDonald | 273/189 A X |
| 3,339,926 | 9/1967 | Coupar | 273/183 B |
| 3,419,277 | 12/1968 | Martin | 273/189 |
| 4,575,089 | 3/1986 | Corbett et al. | 273/183 B |
| 4,612,919 | 9/1986 | Best | 128/77 |

FOREIGN PATENT DOCUMENTS

| | | | |
|---|---|---|---|
| 2166959 | 5/1986 | United Kingdom | 273/189 A |

*Primary Examiner*—George J. Marlo

*Attorney, Agent, or Firm*—Peter D. Keefe

[57] ABSTRACT

A golf swing brace which regulates the angle of bending of the following arm elbow of a golfer so as to truly simulate for the golfer-in-training proper golf swing technique. The golf swing brace includes an upper arm component and a forearm component, each mutually connected by a pivot. Arm bands attach the upper arm component and the forearm component to respective portions of the golfer's following arm (right arm in the case of a right handed golfer). The upper arm and forearm components are oriented so that the pivot is axially in line with the golfer's elbow. Thus, if the pivot is stopped, the golfer cannot bend his or her lead arm at the elbow, but if the pivot is not stopped, the golfer is able to freely bend his or her lead arm at the elbow. The pivot is selectively stopped by operation of an angle-setting adjuster which is connected to the pivot and also connected with the forearm component. An abutment on the angle-setting adjuster abuts the upper arm component so as to stop pivoting at the pivot point. The angle-setting adjuster can be orientationally adjusted relative to the forearm component so that its abutment abuts the upper arm component when the golfer's arm is at a particularly desired degree of bend. Thus, the golfer may simulate a "professional" golf swing in which the right elbow cannot bend more than 90 degrees at the top of the golf swing.

12 Claims, 2 Drawing Sheets

GOLF CLUB SWING TRAINING BRACE

BACKGROUND OF THE INVENTION

1. Field of the Invention

The present invention relates to aids for sports training, and more particularly to a training brace for a golfer to learn proper golf club swing technique. Still more particularly the present invention relates to a brace for the following arm of a golfer which teaches the golfer proper golf club swing technique by imposing control over movement of the golfer's arm at the elbow at the top of the swing.

2. Description of the Prior Art

Many people enjoy the sport of golf for its relaxing out-of-doors qualities. Each of these people dream of perfecting their game. One of the critical factors that determines game performance is golf club swing (hereinafter referred to simply as "swing"). This is because the quality of the swing determines the distance and direction that the golf ball will take upon being addressed (that is, struck) by the club. Standards of swing technique are now well established, which, if followed, would improve the game of many players. In the art of golf, the standard swing is one in which the leading arm (the left arm in the case of right-hand players) remains straight until contact with the golf ball has been made by the club, thereafter the leading arm flexes at the elbow as the swing carries forward under the generated momentum of the swing. The other arm, the following arm, is bent at 90 degrees at the top of the swing. When the following arm is at 90 degrees at the top of the swing, it anatomically follows that the leading arm is straight.

Unfortunately, this swing technique is not easily learned. Swing technique must be both understood and practiced by the player before mastery is achieved. Unfortunately, many golf enthusiasts are not gifted with an ability to easily and quickly master swing technique. These people must either spend a great amount of time in practice, or simply ignore their inadequacy and play the game with an admitted "sloppy" swing. Yet, proper swing can be learned by any golfer, given the right environment to learn.

In the prior art, C. B. Martin in U.S. Pat. No. 3,419,277, dated Dec. 31, 1968, addressed the issue of perfecting swing technique by the utilization of a golfer's brace. Martin proposed a brace having a torso component and an arm component, the arm component being a length adjustable elongate structure adapted to engage primarily the upper arm of the golfer via an arm band. The arm component is hingably connected with the torso component allowing two degrees of freedom of movement. Stops on the torso component regulate possible movement of the arm component in order to place the golfer's arm in a best angle for optimally addressing the golf ball with the club. Martin also addresses the issue of the leading arm of the golfer remaining straight before and during address of the golf ball. Martin indicates that this is achieved by the arm band sliding along the golfer's arm. When the golfer begins his or her swing, the arm band will have slid along the golfer's arm to a position encircling the elbow, thereby preventing flexing of the golfer's leading arm. But, when address of the ball has been accomplished, the arm band will have slid to a position just above the elbow, now permitting the golfer's arm to flex.

Martin's device suffers from a cumbersome structure that is not well suited to its aim. This is primarily because the arm component remains permanently rigid so that control of elbow flexing must be accommodated by slidable movement of an arm band with respect to the elbow. Under normal conditions the arm band must snuggly fit about the upper arm of the golfer, in which case the arm band cannot be expected to easily slide along the arm, resulting in impaired swing movement. Further, the arm band cannot be expected to truly prevent flexing at the elbow, as the mechanical forces generated by the muscles of the golfer require a brace having a far larger lever arm to overcome than that which the width of the arm band would provide. Still further, the arm band would not be expected to provide a mechanically rigid structure that would truly prevent flexing at the elbow. Still further, Martin's drawing depicts a device in which a portion of the arm component extends beyond the elbow at all times, a feature sure to impede arm flexing even when permitted. Therefore, while Martin may sincerely wish to address the issue of elbow flexing of the golfer's arm before and during golf ball addressment, Martin's solution is not sufficiently practical to afford a true solution to the issue.

In a co-pending parent application, a golf swing brace is disclosed composed of a two-part arm brace consisting of an upper arm brace and a forearm brace. The upper arm and forearm braces are mutually connected by a pivot. Arm bands attach the upper arm and forearm braces to the respective portions of the golfer's leading arm (left arm in the case of a right handed golfer). The upper arm and forearm braces are oriented so that the pivot is axially in line with the golfer's elbow. Thus, if the pivot is locked, the golfer cannot bend his or her leading arm at the elbow, but if the pivot is not locked, the golfer is able to freely bend his or her leading arm at the elbow. The pivot is selectively lockable, with selective locking of the pivot being accomplished by movement of a stop pin with respect to an abutment, where the stop pin is connected with the forearm brace and the abutment is connected with the upper arm brace. A sensor and actuator cooperate to move the stop pin at an appropriate juncture so that the golfer may simulate a "professional" swing in which the elbow cannot bend until the ball has been addressed, and is then able to freely bend thereafter.

The above described devices follow traditional thinking concerning the correction of flawed swing technique, in which concentration of correction is confined to keeping the leading arm elbow straight all during the swing until the golf ball has been struck. However, many popular golf training professionals are beginning to transfer their focus from the leading arm to the following arm. This new thinking is based upon the philosophy that the following arm elbow (the right arm elbow for right handed golfers, the left arm elbow for left handed golfers) should never break past 90 degrees in the act of readying for a full swing. In a properly executed golf swing, the leading arm elbow (the elbow of the left arm for right handed golfers) should not be bent if the following arm elbow bends 90 degrees at the top of the golf swing. Thus, this new thinking is to get the following arm elbow to bend at an optimum 90 degrees at the top of the golf swing, then the leading arm elbow will be automatically straight because of the anatomics that are at work.

Accordingly, what is needed is a golf swing brace which regulates elbow bending of the following arm elbow so that the angle of bend is an optimum 90 degrees at the top of the golf swing, thus, as a consequence, causing the leading arm elbow to be straight before and during the golf swing.

SUMMARY OF THE INVENTION

The present invention is a golf swing brace which regulates the angle of elbow bending of the following arm of a golfer so as to truly simulate for the golfer-in-training proper golf swing technique.

The present invention is composed of an arm brace having of an upper arm component and a forearm component. The upper arm and forearm components are mutually connected by a pivot. Arm bands attach the upper arm and forearm components to respective portions of the golfer's following arm (this is the right arm for a right handed golfer, the left arm for a left handed golfer). The upper arm and forearm components are oriented so that the pivot is axially in line with the golfer's elbow. Thus, if the pivot is stopped, the golfer cannot bend his or her following arm at the elbow, but if the pivot is not stopped, the golfer is able to freely bend his or her following arm at the elbow. The pivot is selectively stopped by operation of an angle-setting adjuster which is connected to the pivot and also connected with the forearm component. An abutment on the angle-setting adjuster abuts the upper arm component so as to stop pivoting at the pivot point. The angle-setting adjuster can be orientationally adjusted relative to the forearm component so that its abutment abuts the upper arm component when the golfer's following arm elbow is at a particularly desired degree of bend. Thus, the golfer may simulate a "professional" golf swing in which the following arm elbow cannot bend more than 90 degrees at the top of the golf swing.

Accordingly, it is an object of the present invention to provide a golf swing brace which effectively and truly simulates for a golfer-in-training a professional golf swing.

It is another object of the present invention to provide a golf swing brace which has two mutually pivotable brace components, one attaching to the golfer's upper arm, and the other attaching to the golfer's forearm, limited pivotable movement between the two brace components controlling the golfer's ability to bend his or her following arm at the elbow.

It is yet another object of the present invention to provide a golf swing brace which has two mutually pivotable brace components, one attaching to the golfer's upper arm, and the other attaching to the golfer's forearm, user selected limitations of pivotable movement between the two brace components controlling the golfer's ability to bend his or her following arm at the elbow thereby permitting the golfer-in-training to gradually improve from a "bad" golf swing stance to a professionally proper golf swing stance, and further to practice limited swing shots, such as chipping and putting.

It is yet a further object of the present invention to provide a golf swing brace which keeps both elbows of the golfer in the professionally accepted position for a proper golf swing.

It is still another object of the present invention to provide a golf swing brace which keeps both elbows of the golfer in the professionally accepted position for a proper golf swing, thus promoting: use of the major body muscles in the golf swing, a longer golf swing path, an inside-out golf swing path, and a high finish posture, due to:

1) a proper amount of torso twist at the top of the golf swing, promoted because of limited elbow bending of the following arm at the top of the golf swing;

2) a proper weight shift to the right side of the golfer, promoted because of limited elbow bending of the following arm at the top of the golf swing; and 3) a proper positioning of the golf club at the top of the golf swing (thereby not over-swinging or under-swinging), promoted because of limited elbow bending of the following arm at the top of the golf swing.

These, and additional objects, advantages, features and benefits of the present invention will become apparent from the following specification.

DETAILED DESCRIPTION OF THE PREFERRED EMBODIMENT

Figure 1:
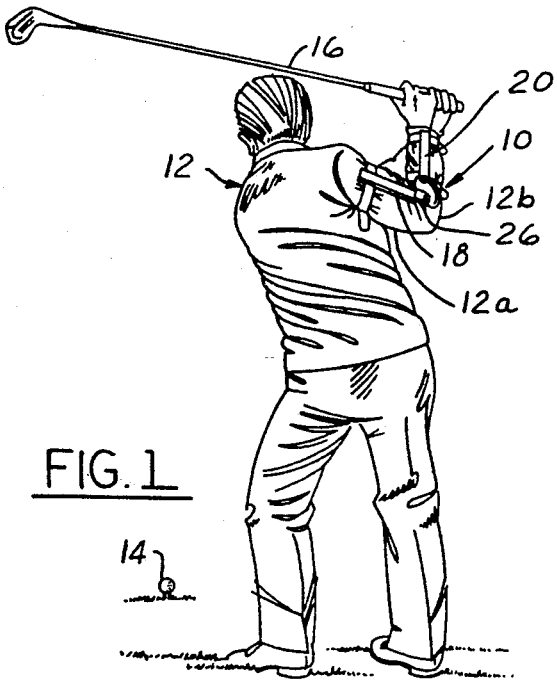
FIG. 1 is a perspective view showing the golf swing brace according to the present invention in operation on the following arm of a right handed golfer.

Referring now to the Drawing, FIG. 1 shows the golf swing brace 10 according to the present invention in operation. Here, it will be seen that the golf swing brace 10 is worn on the following arm of the (right handed) golfer 12. In this depiction, the golfer is at the top of his swing, about to commence a swing to address the golf ball 14 with the golf club 16. Notice that his feet are directed toward the golf ball, and that his shoulders are twisted away from the ball so that the torso of the golfer will participate in the golf swing. This is the professionally accepted stance, as it promotes the greatest power and control at addressment of the golf ball. The golf swing brace 10 is structured to encourage this stance. This is because the golf swing brace 10 won't allow the golfer to bend his following arm more acutely than 90 degrees, thus forcing him to enter the top of the swing by twisting his torso; also, by limiting the flexing of his following arm elbow to 90 degrees, his leading arm is held straight as an automatic anatomical consequence.

The combination of a twisted torso, a straight leading arm, and a following arm bent at 90 degrees being hallmarks of the professionally accepted correct stance at the top of a golf swing.

The structure and function of the golf swing brace 10 will now be described with reference now being requested to FIGS. 2 through 8.

Figure 2:
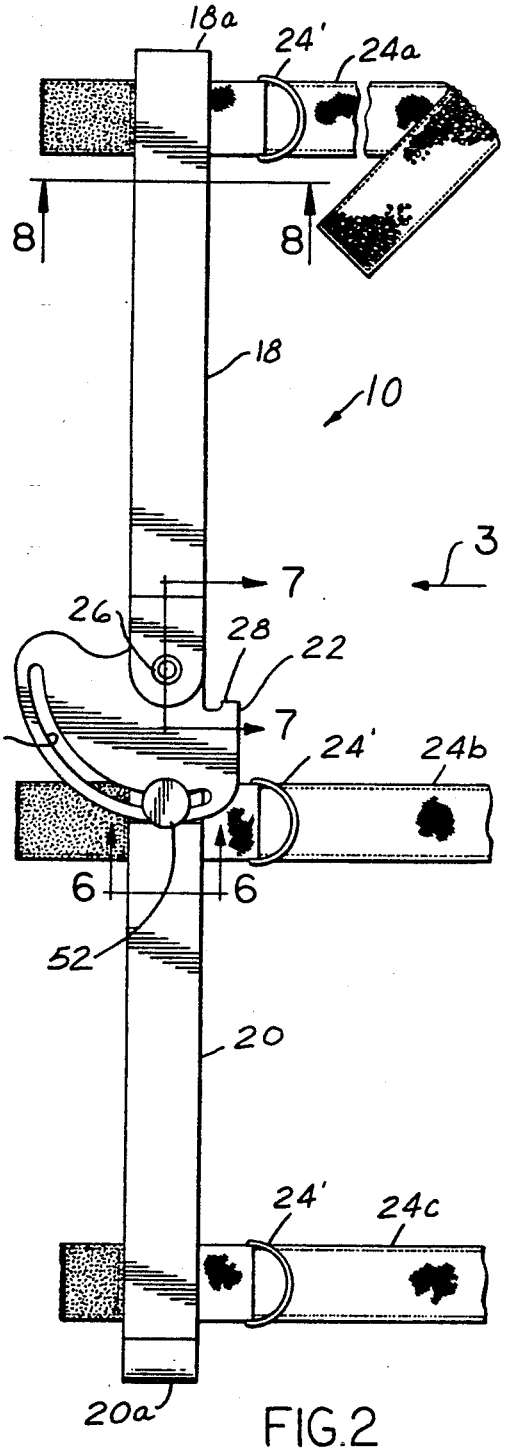
FIG. 2 is a plan view of the golf swing brace according to the present invention.
Figure 3:
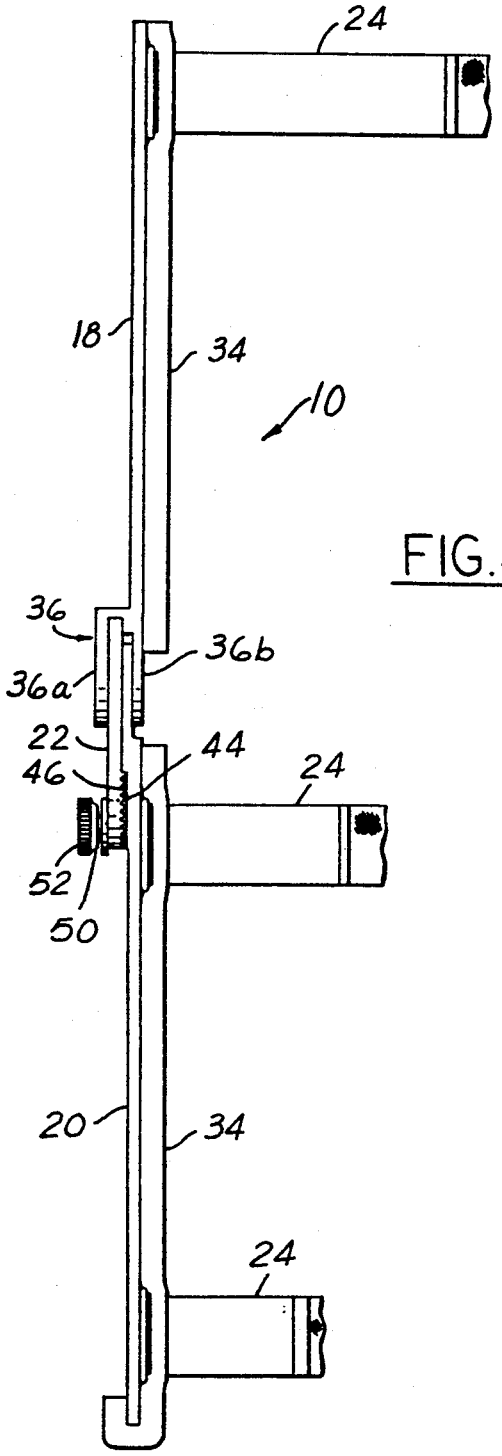
FIG. 3 is a side view of the golf swing brace according to the present invention, seen along arrow 3 in FIG. 2.
Figure 6:
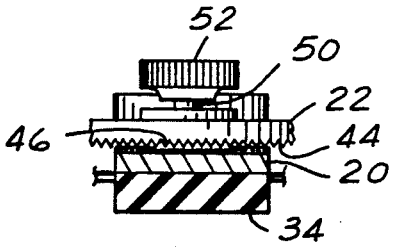
FIG. 6 is a fragmentary detail end view of the golf swing brace according to the present invention, seen along lines 6—6 in FIG. 2.
Figure 7:
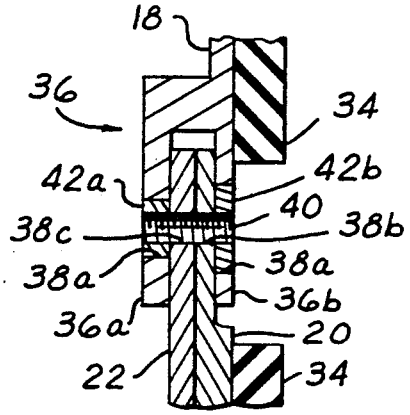
FIG. 7 is a fragmentary detail end view of the golf swing brace according to the present invention, seen along lines 7—7 in FIG. 2.

As can be seen from a general reference to FIGS. 2 and 3, the golf swing brace 10 is composed of the following constituents: an elongate strap-like upper arm component 18, an elongate strap-like forearm component 20 pivotally connected to the upper arm component, an angle-setting adjuster 22 pivotally connected with the upper arm component and further selectively positionable relative to the forearm component, and a plurality of arm bands 24 for releasably connecting the golf swing brace 10 to the golfer's arm in the manner depicted in FIG. 1. It is preferred for the upper arm component, the forearm component and the angle-setting adjuster to be constructed of a durable, non-corrosive, strong material that is resistant to bending, such as plastic or aluminum.

Figure 4:
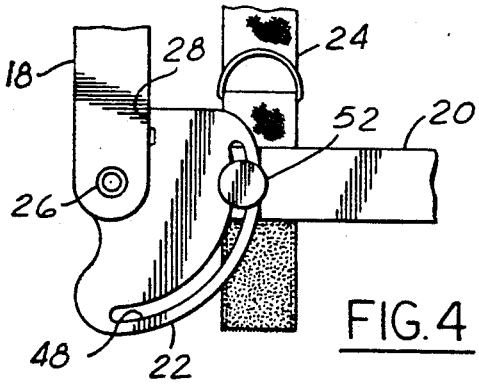
FIG. 4 is a fragmentary detail plan view of the golf swing brace according to the present invention, showing detail adjacent the pivot where the forearm component is stopped at 90 degrees with respect to the upper arm component.

A pivot 26 is provided which permits pivoting of the forearm component 20 relative to the upper arm component 18 within the limits defined by the angle-setting adjuster 22, wherein a minimum acute angle is defined when an abutment 28 on the angle-setting adjuster 22 abuttably engages the upper arm component. In this regard, the preferred angle of stop of 90 degrees is depicted in FIG. 4. Thusly, the forearm component 20 has been pivoted relative to the upper arm component 18 from a 180 degree relative orientation that is shown in FIGS. 2 and 3 to the 90 degree relative orientation that is shown in FIG. 4.

Now with reference again being momentarily directed also to FIG. 1, it will be understood that the golf swing brace 10 is secured to the following arm of the golfer. (The following arm is the right arm of right handed golfers, and the left arm of left handed golfers.) In operation the pivot 26 is located in axial alignment with the golfer's elbow, so that in order for the golfer to bend his or her elbow, he or she must simultaneously pivot the upper arm component 18 relative to the forearm component 20. The upper arm component 18 and forearm component 20 are dimensioned so as to provide a mechanical advantage that comfortably regulates the golfer's arm bending. In this regard, it is preferred for the upper arm component 18 to extend substantially along the upper arm of an average sized golfer, and for the forearm component 20 to substantially extend along the forearm of an average sized golfer, in the manner depicted in FIG. 1.

Figure 8:
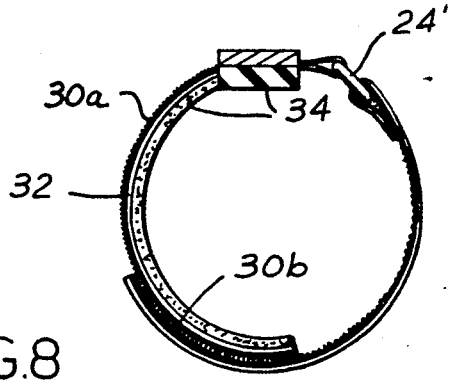
FIG. 8 is an end view of the golf swing brace according to the present invention shown in an operative configuration as would pertain when wrapped around the arm of a golfer, the viewpoint being that indicated by lines 8—8 in FIG. 2.

An upper arm band **24*a* connected to the upper arm component at a location preferably adjacent its remote end 18*a* secures the upper arm component 18 to the upper arm 12*a* of the golfer 12. A first forearm band 24*b* is connected to the forearm component 20 at a location preferably adjacent the pivot 26. A second forearm band 24*c* is connected to the forearm component 20 at a location preferably adjacent its remote end 20*a*. Each of the two forearm bands 24*b*, 24*c* are secured to the forearm 12*b* of the golfer 12. It is preferred for the arm bands 24 to wrap around the arm of the golfer, be threaded through a ring 24', then looped back on itself and thereat secured by a hook and loop fastener 30*a*, 30*b* located on opposing sides of the arm bands. In order that the arm bands function so as to effectively regulate arm movement in unison with respective movement of the upper arm and forearm components 18, 20, it is preferred to include an arm cradle 32 at each arm band 24, each arm cradle 32 being rigidly connected with its respective upper arm component and forearm component. The arm cradles are structured to in part wrap around the arm of the golfer so as to rigidly receive the golfer's arm in order to ensure that his or her arm can bend at the elbow only if the forearm and upper arm components relatively pivot at pivot 26. It is preferred for each arm band to wrap over its respective arm cradle to thereby more firmly secure the golf swing brace 10 to the following arm of the golfer. Foam padding 34 attached to the upper arm component, forearm component and arm cradles is provided for purposes of the golfer's comfort during operation of the golf swing brace 10. The general operative construction of the arm bands and arm cradles is depicted in FIG. 8**.

It is preferred for the golf swing brace 10 to be provided with an adjustment feature that selectively regulates the limits of bend of the golfer's elbow. This is important because a golfer-in-training may not be able to immediately train at the professionally accepted 90 degree elbow bend at the top of the golf swing. This golfer needs to be able to gradually improve his or her golf swing, from say 70 or 80 degrees to the professionally accepted 90 degrees. For some golfers, a 90 degree elbow bend may not be to their best advantage. These golfers will want to experiment with their performance at various elbow bends until they find their particular optimum. Further, many shots don't require a full swing. In these cases, such as in chipping or putting, the golfer will want to fine tune his or her elbow bend to develop the best golf swing tempo for certain shots. Accordingly, the angle-setting adjuster 22 is provided to allow for user selection of the angular range of movement between the upper arm component 18 and the forearm component 20 at the pivot 26.

Figure 5:
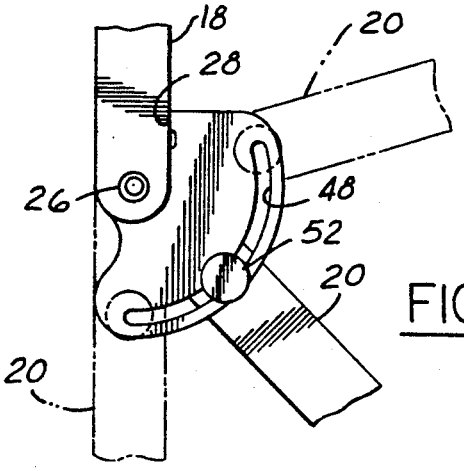
FIG. 5 is a fragmentary detail plan view of the golf swing brace according to the present invention, showing detail adjacent the pivot where the forearm component is stopped at other than 90 degrees with respect to the upper arm component.

To carry-out the adjustment of the pivot angle range of the golf swing brace 10, the following structure is preferred to be utilized. The upper arm component 18 terminates at one end in a clevis 36. A hole **38*a* is provided through the clevis 36, which serves as the basis of the pivot 26. One end of the forearm component 20 inserts into the clevis, this end being provided with a hole 38*b*. A portion of the angle-setting adjuster 22 also inserts into the clevis, and is provided with a hole 38*c*. The width of the inserted end of the forearm component 20 and inserted portion of the angle-setting adjuster 22 is such as to fill the space between the forks 36*a*, 36*b* of the clevis 36. Each of the holes 38*a*, 38*b*, 38*c* is aligned and a pivot bolt 40 is placed therethrough and threadably secured at each of the forks 36*a*, 36*b* of the clevis 36 by nuts 42*a*, 42*b*. The angle-setting adjuster 22 is provided with a serrated portion 44 which faces toward the forearm component 20. The forearm component is provided with a serrated portion 46 which faces toward the serrated portion 44 of the angle-setting adjuster. A curved slot 48 is provided in the angle-setting adjuster adjacent the serrated portion 44. A setscrew 50 projects from the forearm component 20 and passes upwardly through the curved slot 48. A knurled nut 52 is threaded onto the setscrew 50. To adjust the angle of allowable pivot, the knurled knob is loosened and the angle-setting adjuster is lifted to separate the serrated portions 44, 46 from each other and then rotated on the pivot 26 relative to the forearm component 20 so that the abutment 28 will strike the upper arm component 18 when the desired angle of pivot is reached. Thereupon, the angle-setting adjuster 22 is released so that the serrated portions 44, 46 mutually engage, and the knurled knob is then tightened. FIG. 5 depicts how this orientational adjustment of the angle-setting adjuster relative to the forearm component affects the angle of pivot permitted by interaction between the abutment 28 and the upper arm component 18**.

In operation, the golfer places the golf swing brace against his or her following arm, axially aligning the pivot 26 with the elbow, with the arm resting in the arm cradles. Each of the arm bands is then wrapped around the arm, threaded through its respective ring, then looped back on itself and secured by the hook and loop fastener. The arm is then bent at the elbow to see what angle the forearm is at when the abutment 28 strikes the upper arm component. An orientational adjustment of the angle-setting adjuster relative to the forearm component is made if necessary. Then the golfer proceeds to practice golf swings, in time acquiring a learned golf swing technique worthy of a professional golfer.

To those skilled in the art to which this invention appertains, the above described preferred embodiment may be subject to change or modification. For instance, the abutment 28 can be directly located on either of the forearm component 20 and the upper arm component 18 in the event pivot angle adjustment is not needed. Also, while the golf swing brace 10 is shown with the angle-setting adjuster 22 adjustably connected with the forearm component 20, it is mechanically just as feasible to adjustably connect the angle-setting adjuster with the upper arm component 18, the clevis then being located on the forearm component. Such change or modification can be carried out without departing from the scope of the invention, which is intended to be limited only by the scope of the appended claims.

What is claimed is:

1. A brace for training a golfer proper golf swing technique of a golf club with respect to a golf ball, said brace being connectable to the following arm of the golfer, said brace comprising:

an elongated forearm component, said forearm component being structured to extend a substantial length along of the golfer's forearm;

forearm attachment means for connecting said forearm component to the forearm of the golfer;

an elongated upper arm component, said upper arm component being structured to extend a substantial length along the golfer's upper arm;

upper arm attachment means for connecting said upper arm component to the upper arm of the golfer;

pivot means connected with said forearm component and said upper arm component for pivotally connecting said forearm component with respect to said upper arm component; and pivot control means for limiting pivotability of said forearm component relative said upper arm component within a selected range of angles between a first maximum angle wherein said components are aligned and a plurality of minimum angles when said components are not aligned:

so that the golfer may attach said upper arm component to and parallel with the upper arm of the following arm and said forearm component to and parallel with the forearm of the following arm with said pivot means being axially aligned with the elbow of the following arm, the golfer thereupon bring unable to bend the elbow beyond said minimum angle.

2. The brace of claim 1, wherein said pivot control means comprises abutment means connected with one of said forearm component and said upper arm component for abutting the other of said forearm component and said upper arm component so as to limit pivoting of said forearm component relative to said upper arm component to an acute angle equal to said minimum angle.

3. The brace of claim 1, wherein said pivot control means further comprises:

an angle-setting adjuster connected to said pivot means and said forearm component;

abutment means connected with said angle-setting adjuster; and orientation adjustment means connected with said forearm component and said angle-setting adjuster for selectively setting an orientation of said angle-setting adjuster relative to said forearm component so that said abutment means abuts said upper arm component at an angle of said forearm component relative to said upper arm component that is equal to a selected angle between said maximum and said minimum angles, said abutting of said abutment means with said upper arm component limiting pivoting of said forearm component relative to said upper arm component to an acute angle no less than said selected angle.

4. The brace of claim 3, further comprising:

forearm cradle means connected with said forearm component for assisting to hold said forearm component parallel with respect to the golfer's forearm; and upper arm cradle means connected with said upper arm component for assisting to hold said upper arm component parallel with respect to the golfer's upper arm.

5. The brace of claim 4, wherein said forearm cradle means comprises at least one forearm cradle which is structured to wrap around a portion of the forearm of the golfer; and wherein said upper arm cradle means comprises at least one upper arm cradle which is structured to wrap around a portion of the upper arm of the golfer.

6. The brace of claim 5, wherein said forearm attachment means comprises at least one flexible forearm arm band which is structured to wrap around the forearm of the golfer and be selectively held tightly about the forearm; and wherein said upper arm attachment means comprises at least one flexible upper arm band which is structured to wrap around the upper arm of the golfer and be selectively held tightly about the upper arm.

7. The brace of claim 6, wherein each forearm arm band wraps about a respective forearm cradle when being wrapped about the forearm of the golfer; and wherein each upper arm band wraps about a respective upper arm cradle when being wrapped about the upper arm of the golfer.

8. The brace of claim 1, wherein said pivot control means further comprises:

an angle-setting adjuster connected to said pivot means and said upper arm component;

abutment means connected with said angle-setting adjuster; and orientation adjustment means connected with said upper arm component and said angle-setting adjuster for selectively setting an orientation of said angle-setting adjuster relative to said upper arm component so that said abutment means abuts said forearm component at an angle of said forearm component relative to said upper arm component that is equal to a selected angle between said maximum and said minimum angles, said abutting of said abutment means with said forearm component limiting pivoting of said forearm component relative to said upper arm component to an acute angle no less than said selected angle.

9. The brace of claim 8, further comprising:

forearm cradle means connected with said forearm component for assisting to hold said forearm component parallel with respect to the golfer's forearm; and upper arm cradle means connected with said upper arm component for assisting to hold said upper arm component parallel with respect to the golfer's upper arm.

10. The brace of claim 9, wherein said forearm cradle means comprises at least one forearm cradle which is structured to wrap around a portion of the forearm of the golfer; and wherein said upper arm cradle means comprises at least one upper arm cradle which is structured to wrap around a portion of the upper arm of the golfer.

11. The brace of claim 10, wherein said forearm attachment means comprises at least one flexible forearm arm band which is structured to wrap around the forearm of the golfer and be selectively held tightly about the forearm; and wherein said upper arm attachment means comprises at least one flexible upper arm band which is structured to wrap around the upper arm of the golfer and be selectively held tightly about the upper arm.

12. The brace of claim 11, wherein each forearm arm band wraps about a respective forearm cradle when being wrapped about the forearm of the golfer; and wherein each upper arm band wraps about a respective upper arm cradle when being wrapped about the upper arm of the golfer.

* * * * *